US006689974B2

(12) United States Patent
Guillot

(10) Patent No.: US 6,689,974 B2
(45) Date of Patent: Feb. 10, 2004

(54) PRESSURE SWITCH FOR MOTORIZED CHAIRS

(75) Inventor: Edmond P. Guillot, Conover, NC (US)

(73) Assignee: Hickory Springs Manufacturing Co., Hickory Springs, NC (US)

( * ) Notice: Subject to any disclaimer, the term of this patent is extended or adjusted under 35 U.S.C. 154(b) by 55 days.

(21) Appl. No.: 10/080,031

(22) Filed: Feb. 21, 2002

(65) Prior Publication Data

US 2003/0155224 A1 Aug. 21, 2003

(51) Int. Cl.[7] ..... H01H 13/16
(52) U.S. Cl. ..... 200/85 A; 200/85 R
(58) Field of Search ..... 200/61.41–61.43, 200/51 LM, 85 R, 85 A, 511, 512, 334; 340/666, 667

(56) References Cited

U.S. PATENT DOCUMENTS

| | | | | | |
|---|---|---|---|---|---|
| 2,636,950 | A | | 4/1953 | Boadway | 200/51.07 |
| 3,639,709 | A | | 2/1972 | Hart et al. | 200/51 |
| 3,703,618 | A | * | 11/1972 | Lewis | 200/85 A |
| 3,715,541 | A | * | 2/1973 | Koenig | 200/86 R |
| 3,729,751 | A | | 5/1973 | Kirkman | 5/66 |
| 3,757,063 | A | | 9/1973 | Hart et al. | 200/51.07 |
| 3,761,658 | A | * | 9/1973 | Loose et al. | 200/85 R |
| 3,812,313 | A | | 5/1974 | Wolf et al. | 200/86 R |
| 3,832,503 | A | | 8/1974 | Crane | 200/51 R |
| 3,894,206 | A | | 7/1975 | Suzuki et al. | 200/85 A |
| 4,007,960 | A | | 2/1977 | Gaffney | 297/71 |
| 4,075,443 | A | * | 2/1978 | Fatur | 200/85 A |
| 4,534,077 | A | | 8/1985 | Martin | 5/424 |
| 4,620,077 | A | | 10/1986 | Zdanys, Jr. et al. | 200/331 |
| 4,707,027 | A | | 11/1987 | Horvath et al. | 297/284 |
| 4,786,107 | A | | 11/1988 | Crockett | 297/330 |
| 4,970,446 | A | | 11/1990 | Yaguchi | 318/280 |
| 5,024,486 | A | | 6/1991 | Auel | 297/330 |
| 5,029,939 | A | | 7/1991 | Smith et al. | |
| RE33,675 | E | | 8/1991 | Young | 180/167 |
| 5,052,065 | A | | 10/1991 | West | 5/424 |
| 5,115,109 | A | | 5/1992 | Fisher | 200/86 A |
| 5,290,981 | A | | 3/1994 | Yuda | 200/296 |
| 5,319,813 | A | | 6/1994 | DiMatteo et al. | 5/81.1 |
| 5,390,852 | A | | 2/1995 | Schuenemann et al. | 239/263.1 |
| 5,473,313 | A | | 12/1995 | Graebe, Jr. | 340/626 |
| 5,540,479 | A | | 7/1996 | Thomas et al. | 297/113 |
| 5,748,473 | A | | 5/1998 | Breed et al. | 364/424.055 |
| 5,875,886 | A | | 3/1999 | Elster | 200/331 |
| 5,918,696 | A | | 7/1999 | VanVoorhies | 180/273 |
| 5,931,532 | A | | 8/1999 | Kemmerer et al. | 297/330 |
| 5,957,491 | A | | 9/1999 | Cech et al. | 280/735 |
| 6,019,429 | A | | 2/2000 | Tedesco | 297/328 |
| 6,021,863 | A | | 2/2000 | Stanley | 180/273 |
| 6,039,344 | A | | 3/2000 | Mehney et al. | 280/735 |
| 6,056,079 | A | | 5/2000 | Cech et al. | 180/273 |
| 6,092,838 | A | | 7/2000 | Walker | 280/735 |
| 6,106,065 | A | | 8/2000 | Carroll | 297/330 |
| 6,113,139 | A | | 9/2000 | Heximer et al. | 280/735 |
| 6,152,529 | A | | 11/2000 | Beason | 297/260.2 |
| 6,255,790 | B1 | * | 7/2001 | Popp et al. | 318/280 |
| 6,271,760 | B1 | * | 8/2001 | Watanabe et al. | 340/667 |

* cited by examiner

*Primary Examiner*—Michael Friedhofer
(74) *Attorney, Agent, or Firm*—Alston & Bird LLP

(57) ABSTRACT

A pressure switch strip assembly for use with a motorized chair having user-supporting elements that support a user and are movable by a motor connected by a circuit to a controller. The pressure switch strip assembly includes a pair of elongate contact strips that extend over a spring in one of the user-supporting elements. The contact strips are separated by spacers in a "normally open" position that prohibits operation of the motor by the controller. Between the contact strips and the spring is a contact wire that acts as a pressure point to deflect the contact strips together. Deflection of the contact strips closes the circuit between the controller and motor, allowing control of the chair by the user resting thereon. A pair of the pressure switch strips may be spaced apart across the user-supporting element so as to detect the user in several positions on the user-supporting element.

22 Claims, 8 Drawing Sheets

PRESSURE SWITCH FOR MOTORIZED CHAIRS

FIELD OF THE INVENTION

The present invention relates to the field of motorized furniture, and more particularly, controllers for motorized furniture.

BACKGROUND OF THE INVENTION

Reclining chairs, loveseats, and sofas are well known in the art and have become a mainstay in many households. Manual recliners typically utilize a lever or handle extending along one side of the recliner which is manually moved to release an ottoman or footrest from the front of the chair and allow the chair to be reclined into a more prone position. Some amount of force must be exerted upon the lever to recline the chair. Likewise, another force must be exerted on the lever to bring the chair back to the original position. Disadvantageously, these manually-actuated chairs can be difficult to use for certain users, such as the elderly or physically impaired.

More recently, motorized devices have been developed that provide powered movement of a chair or the like. Motorized recliners have also been developed that allow the recliner to be adjusted into various reclined positions. U.S. Pat. No. 4,786,107 to Crockett discloses an apparatus for elevating and lowering an entire free standing and pre-existing seating structure, such as a house chair, recliner or sofa. In particular, the lift apparatus 20 includes an elevator means 34, a power means 44, and a control means 46. In operation, a user presses the control means or switch 46 that is secured adjacent to the armrest of the seating structure and that is connected to an electric motor 92. The switch 46 can start or stop the movement of the elevator means 34 in either direction, up or down, at any point in the range of travel of the elevator means so that the user can lower or raise themselves from the seating structure.

Motorized recliners increase consumer comfort along with safety and convenience. Control of a motorized recliner is typically accomplished by using a hand-operated device that is accessible to a seated user. The user may manipulate the hand-operated controller to achieve the desired seated position. Some controllers are attached to the motorized recliner with an electrical cord that allows the controller to be moved to different positions on the recliner. Although convenient, such controllers may be dropped, or lodged in between moving surfaces of the recliner. In such an instance, switches or buttons on the controller may be inadvertently activated, causing the recliner to move at undesired times and to undesired positions when a user is not seated in the recliner. Further, control of motorized recliners by small children or persons not seated in the recliner is also undesirable due to safety considerations.

It would be advantageous to have a mechanism for shutting off a motorized recliner. More particularly, it would be advantageous to have a mechanism for shutting off a motorized recliner when the user is not seated in the recliner.

SUMMARY OF THE INVENTION

The present invention addresses the above needs and achieves other advantages by providing a pressure switch strip assembly for use with a motorized seat having user-supporting elements that support a user resting thereon and are movable relative to each other by a motor connected by a circuit to a controller. One of the user-supporting elements of the seat includes a plurality of springs for resiliently supporting the user. The pressure switch strip assembly includes a pair of elongate contact strips mounted on one of the springs of the user-supporting element. The contact strips are separated by spacers in a "normally open" position that prohibits operation of the motor by the controller. Between the contact strips and the spring is a contact wire that acts as a pressure point to deflect the contact strips together when a user is resting on the user-supporting element. Deflection of the contact strips into contact with each other closes the circuit between the controller and motor, allowing control of the motorized chair by the user using the controller. A pair of the pressure switch strips may be spaced apart across the user-supporting element, each with a contact wire and mounted substantially along the length of one of the contact springs, so as to detect the user in several positions on the user-supporting element.

In one aspect, the user-supporting element includes a pair of spaced supports supporting the ends of the springs. Preferably, the springs are elongate stretcher springs having a sinusoidal pattern and are spaced apart from each other along the spaced supports. Optionally, a second pressure switch strip may be employed on a separate one of the springs.

In another embodiment, the present invention includes a pressure strip assembly comprising a pair of elongate contact strips and a contact wire. The pair of elongate contact strips are separated by spacers and have a length substantially the same as one of the stretcher springs. In addition, the elongate strips are configured to extend over one side of the stretcher spring and are further configured for connection to the circuit between the motor and the controller. The contact wire also has a length substantially the same as the stretcher spring and is configured to extend between the stretcher spring and the contact strips. In this manner, a user resting on the motorized seat causes the contact strips to deform about the contact wire. Such deformation closes the circuit and allows the user to control the motor with the controller and to move the user-supporting elements.

In one aspect, the assembly also includes a connection strip configured to extend along another side of the stretcher spring and to intermittently contact the contact strips in the interstices between the wires of the stretcher spring so as to hold the contact strips on the stretcher spring. Preferably, the connection strip is a loop strip and a pile strip with one of the loop and pile strips adhered to the underside of the contact strips, on one side of the stretcher spring, and the other of the loop and pile strips on the opposite side of the stretcher spring. The length of the contact strips and contact wire preferably extends to within 4.75 inches of the back-rest.

The present invention has several advantages. The pressure switch strips are normally open, blocking inadvertent motion of the motorized chair when a user is not seated in the chair. In addition, positioning two of the pressure switch strips on spaced apart stretcher springs allows the strips to detect the user in a variety of seated positions. Such sensitivity is further augmented by the length of the pressure switch strips extending substantially along the length of the springs. The use of a contact wire between the contact strips and the wire of the stretcher springs increases the sensitivity of the assembly to the weight of the user and allows the use of seat cushions between the user and the contact strips.

BRIEF DESCRIPTION OF THE DRAWINGS

Figure 1:
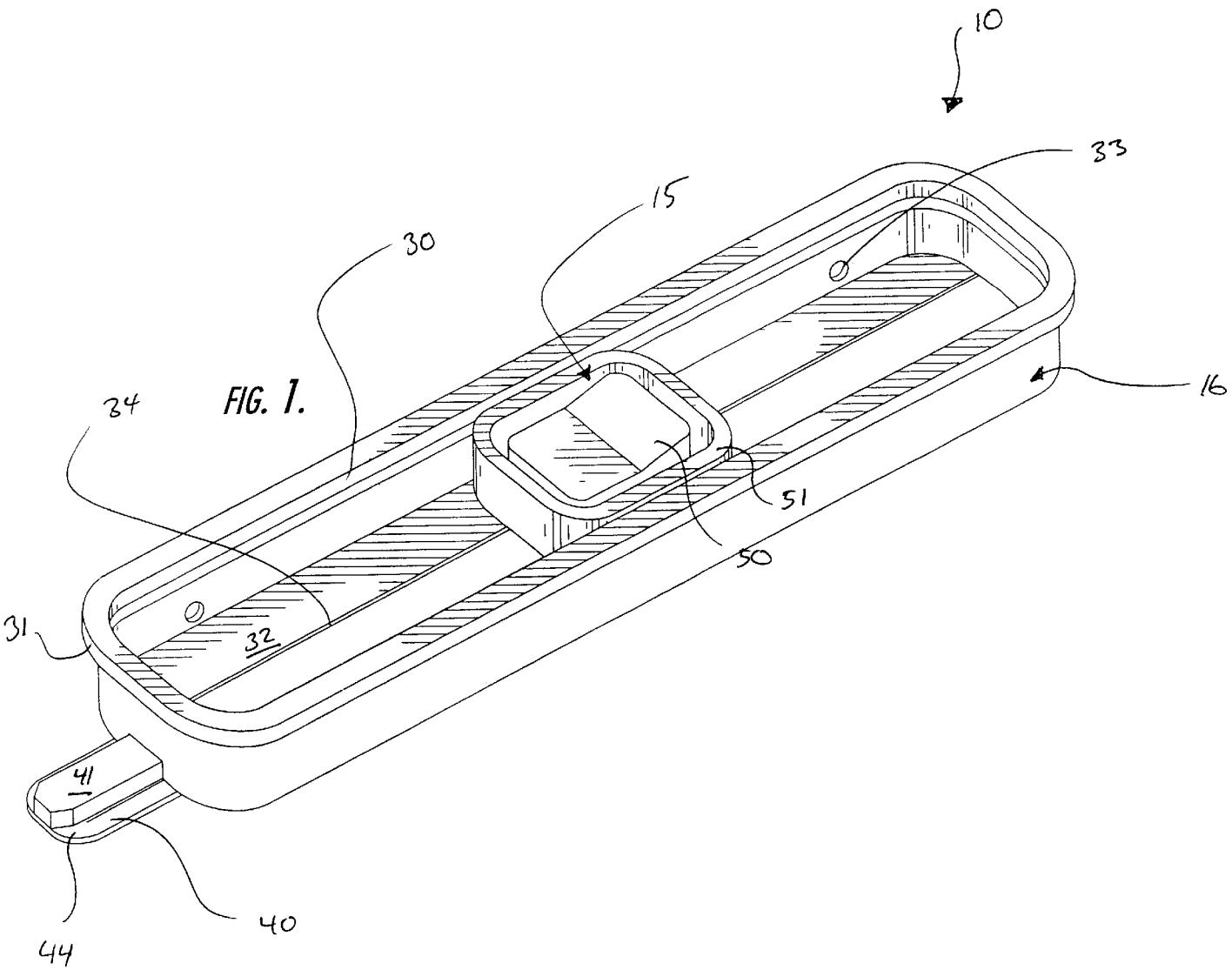
Figure 2:
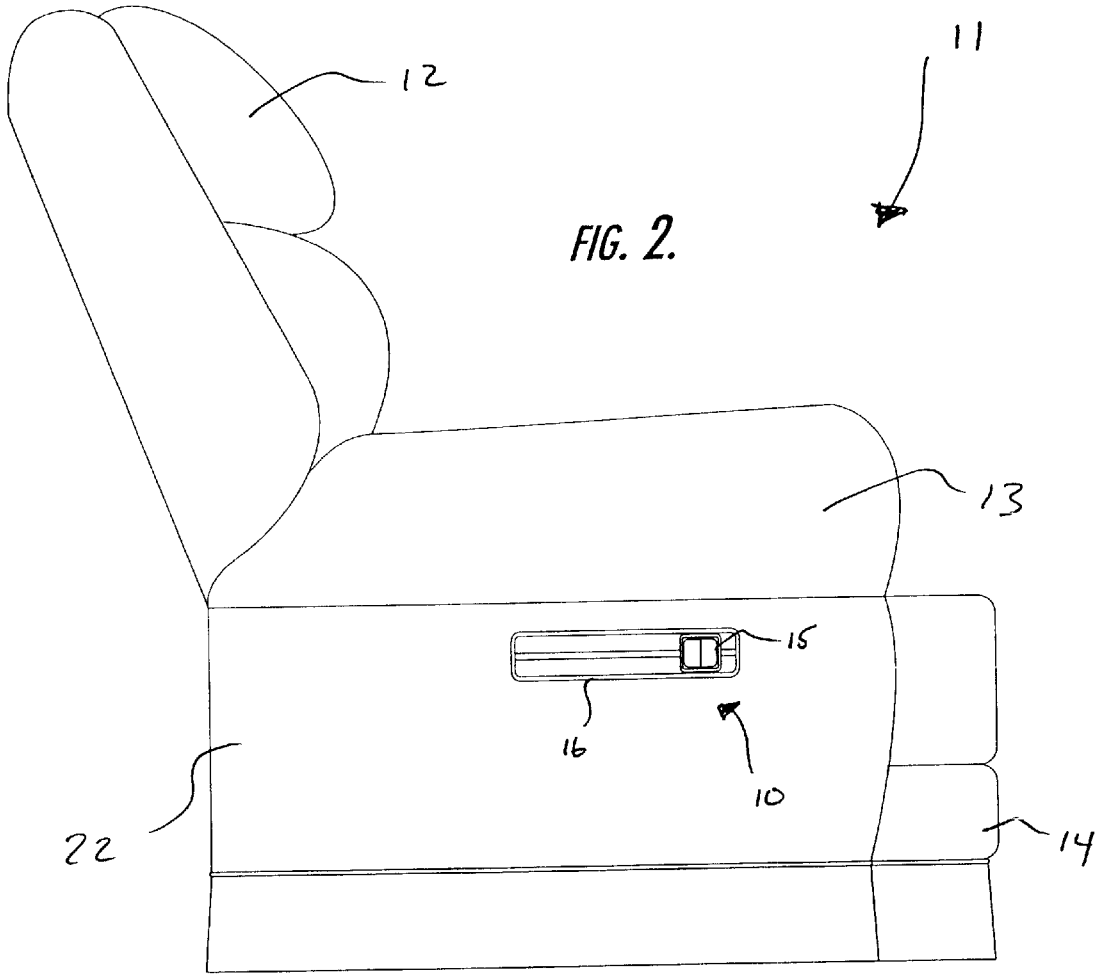
Figure 3:
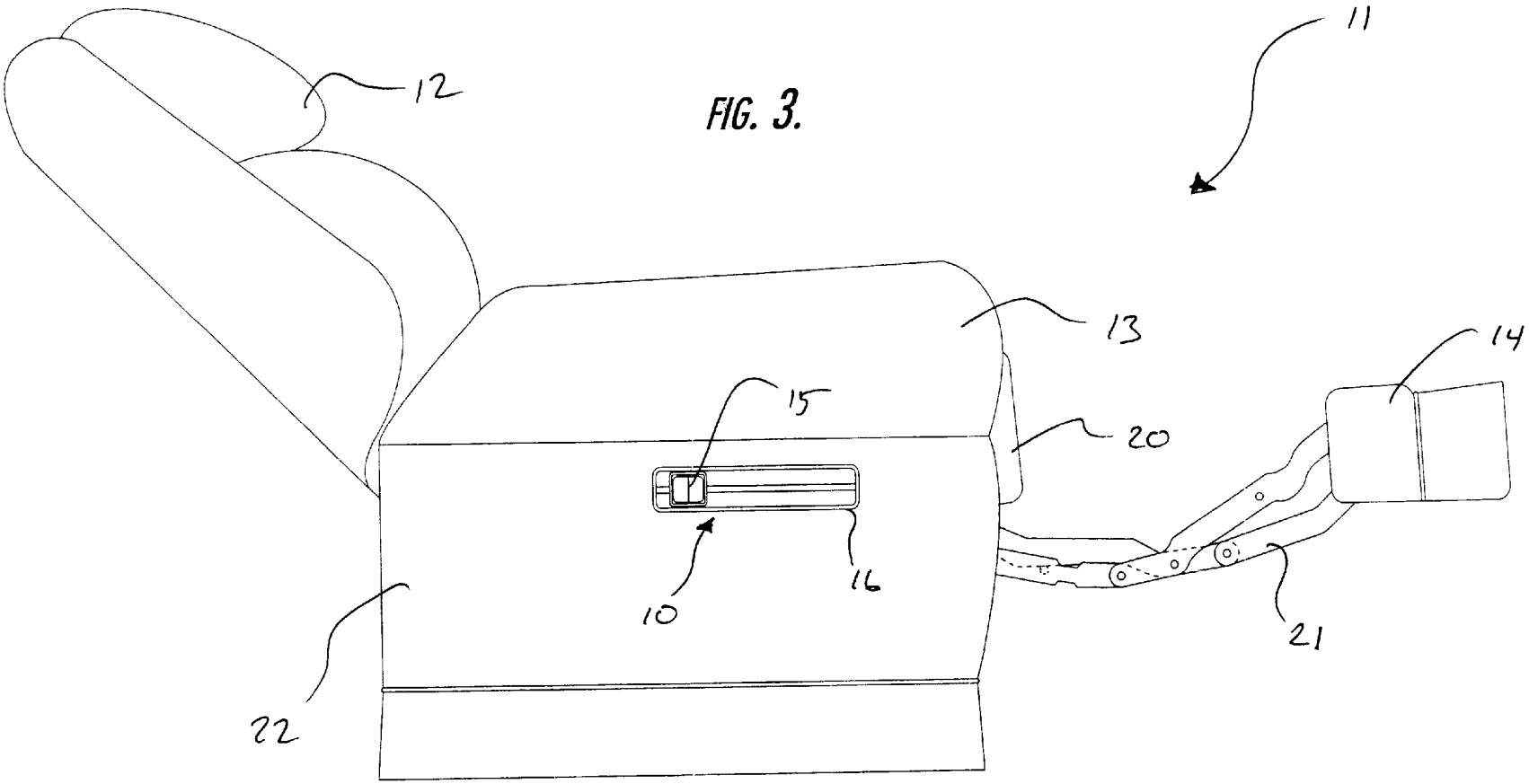
Figure 4:
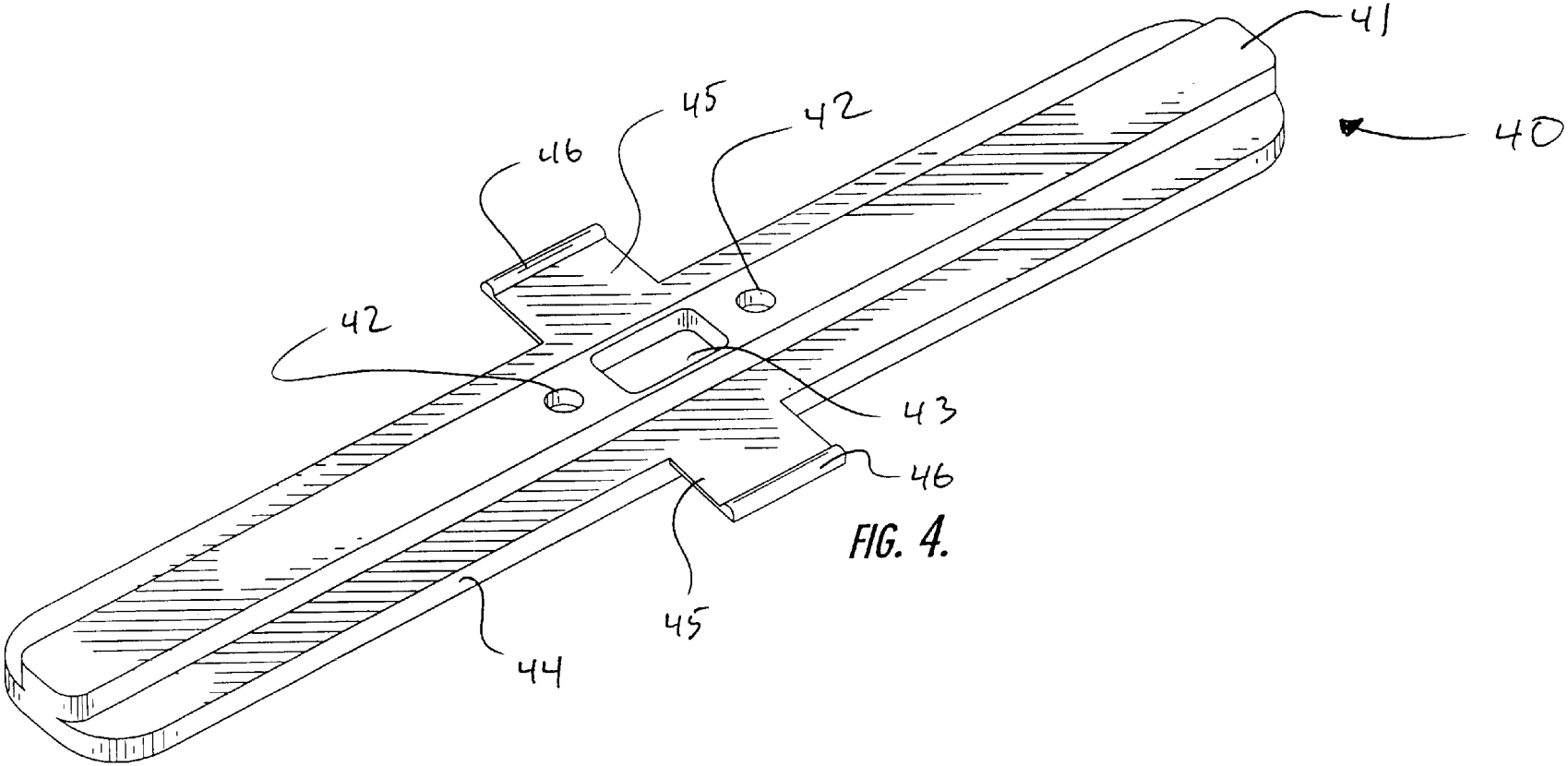
Figures 5A, 5B, 7:
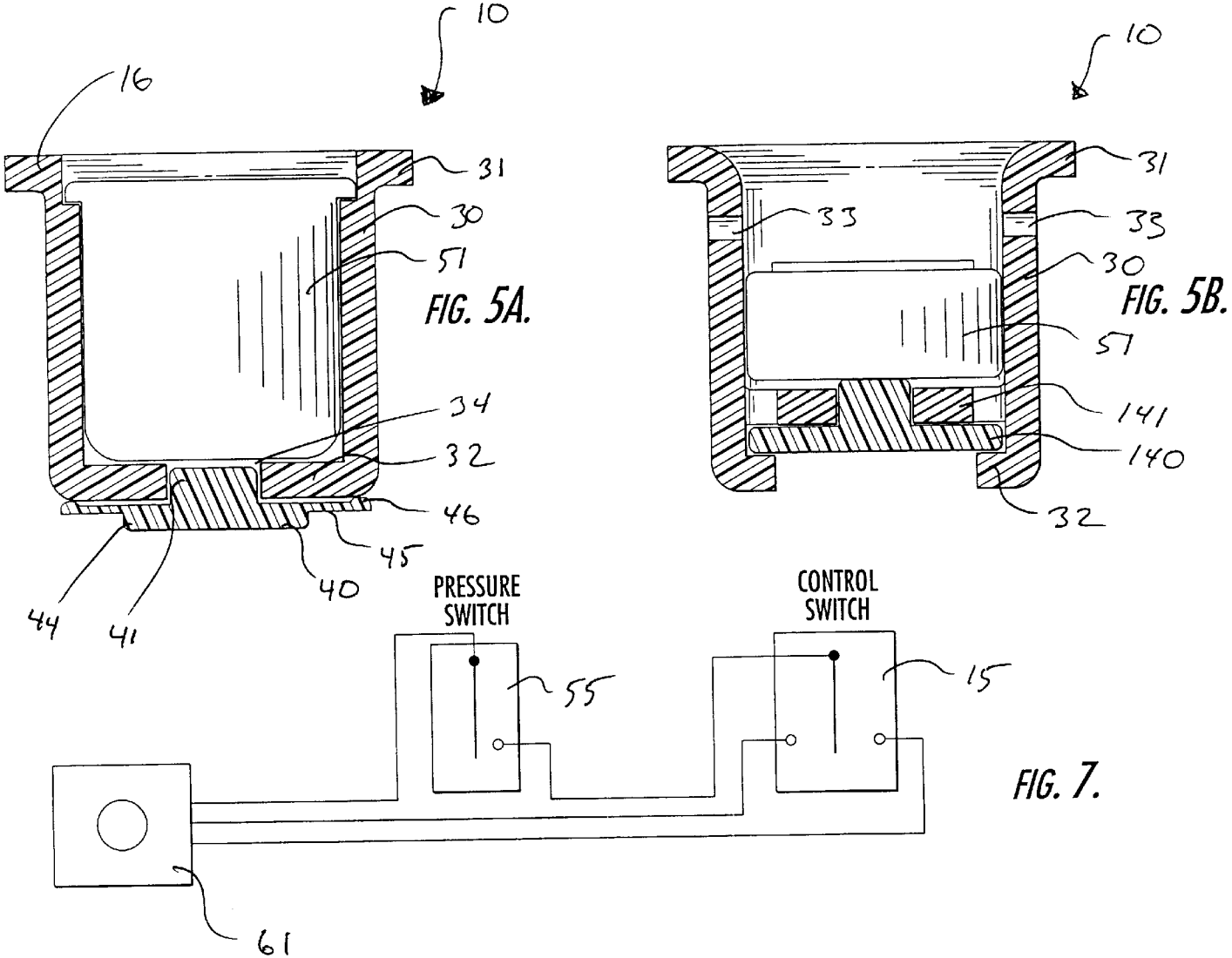
Figure 6:
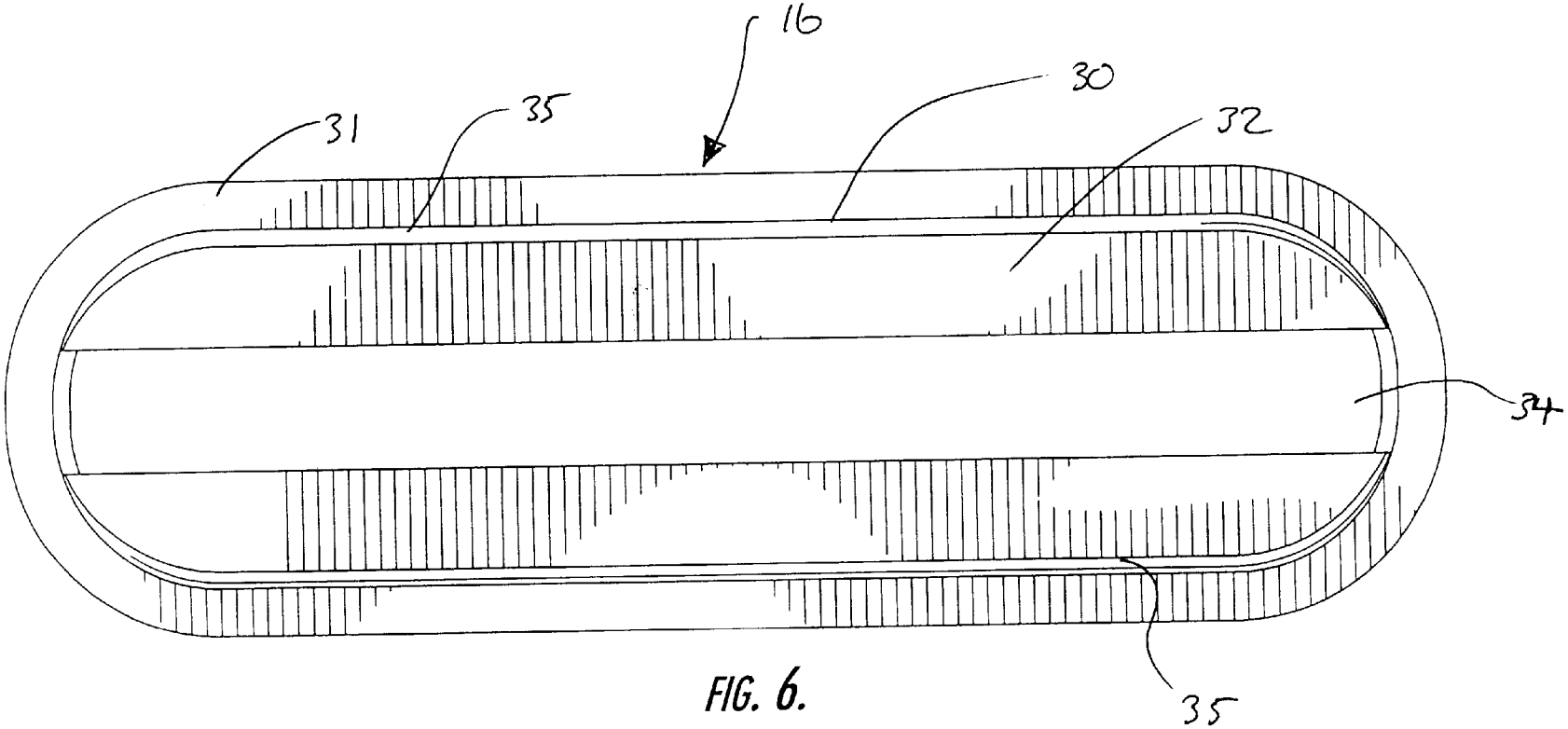
Figure 8:
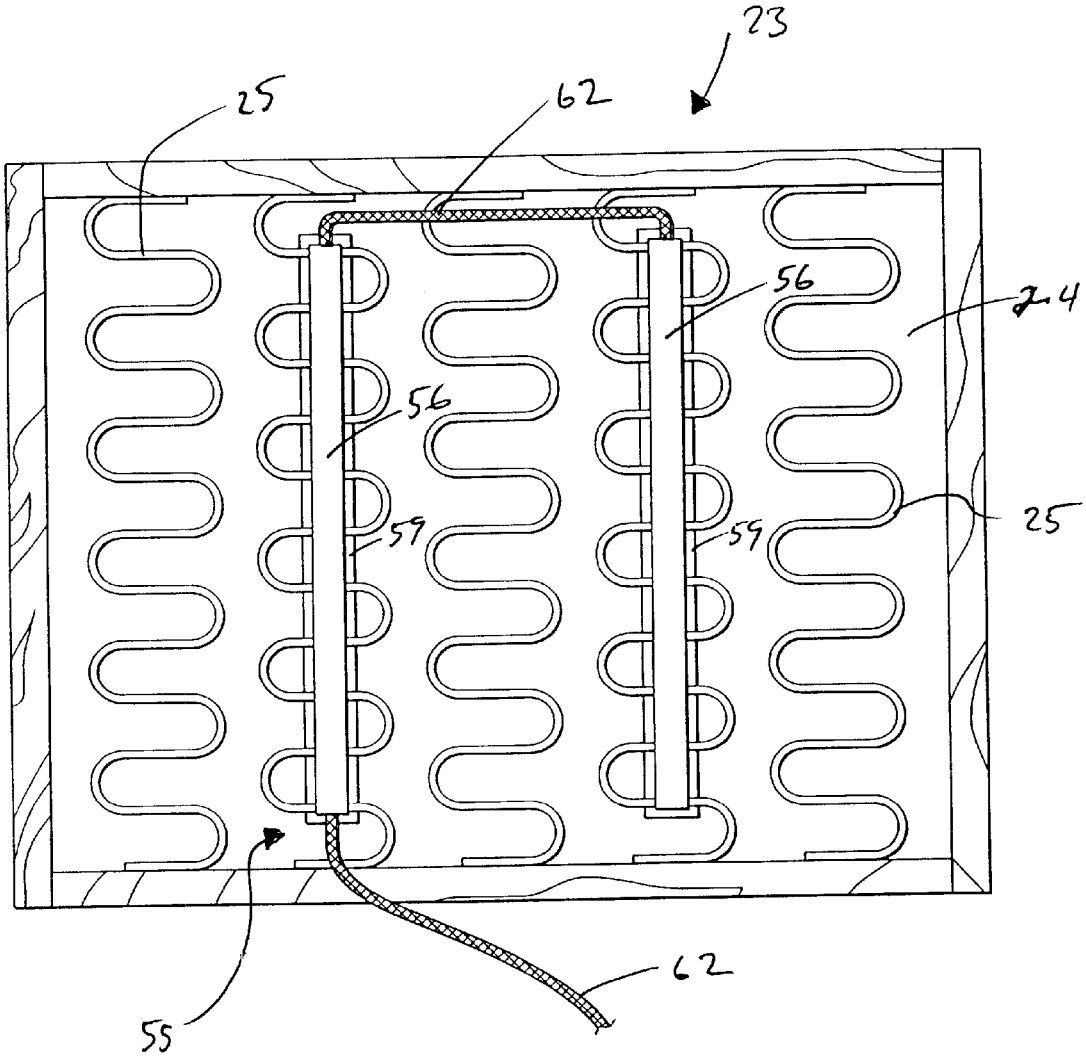
Figure 9:
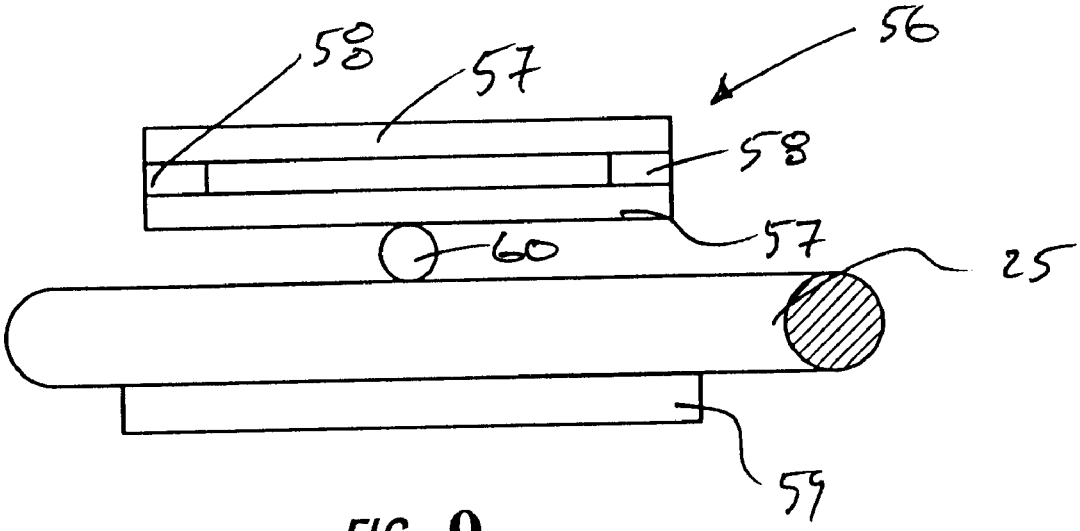
Figure 10:
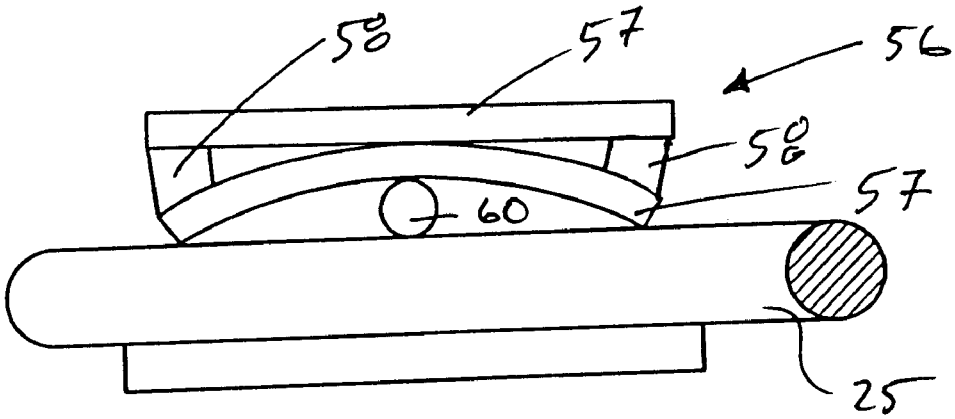

Having thus described the invention in general terms, reference will now be made to the accompanying drawings, which are not necessarily drawn to scale, and wherein:

FIG. 1 shows a plan view of a position controller assembly of one embodiment of the present invention;

FIG. 2 shows a side elevational view of a motorized reclining sofa of the present invention in an upright position and including the controller assembly shown in FIG. 1;

FIG. 3 shows a side elevational view of the motorized reclining sofa of FIG. 2 in a reclining position;

FIG. 4 shows perspective view of a sliding member of the switch assembly shown in FIG. 1;

FIG. 5A shows a cross-sectional view of a control switch and track of another embodiment of the controller assembly of the present invention;

FIG. 5B shows a cross-sectional view of a control switch and track of yet another embodiment of the controller assembly of the present invention;

FIG. 6 is a plan view of the bottom of a track of the controller assembly shown in FIG. 1;

FIG. 7 is an electrical diagram of another embodiment of a controller assembly of the present invention including a pressure switch;

FIG. 8 is a plan view of the pressure switch of FIG. 7 mounted on a seat base of the sofa shown in FIGS. 2 and 3;

FIG. 9 is a cross-sectional view of a contact strip of the pressure switch shown in FIG. 8; and FIG. 10 is a cross-section view of the strip of FIG. 9 deflected under loading.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

One embodiment of a position controller assembly 10 of the present invention is shown in FIG. 1. The controller assembly is fixed to the frame of a motorized, reclining sofa chair 11 having a backrest 12, a pair of armrests 13 and a footrest 14, as shown in FIG. 2. The controller assembly 10 includes a control switch 15 that is slidably mounted in a track 16 on a side of the chair 11, below one of the armrests 13. The control switch 15 controls motorized reclining of the backrest 12 and motorized extension of the footrest 14 via a footrest linkage 21, and slides in the track 16 to within reach of a sofa user even when the sofa chair 11 is in the filly reclined position, as shown in FIG. 3. Operation of the control switch 15 is described in commonly assigned U.S. application Ser. No. 10/080,224 entitled "Movable Switch for a Motorized Recliner" filed on Feb. 21, 2001, which is hereby incorporated herein in its entirety by reference.

The motorized sofa chair also includes a seat cushion 20 disposed between the armrests 13 for the seating comfort of the sofa chair user. The seat cushion 20, backrest 12, pair of armrests 13 and footrest 14 are supported by a seat base 22. The seat base 22 includes a box-shaped wooden subframe 23, as shown in FIG. 8, which generally gives the seat base its rectangular shape and provides structural support for the other sofa chair 11 frame elements discussed above. The walls of the wooden subframe 23 define a seating area for supporting the seat cushion 20. A plurality of stretcher springs 25 span the seating area and have ends that are attached to the front and back walls of the subframe 23. The stretcher springs 25 provide resilient support for the seat cushion and the sofa user. The footrest linkage 21 is powered by a motor to extend and retract the footrest 14 in response to activation of the control switch 15. Motorized sofa chairs and motor powered linkages for such chairs are known in the art and are therefore not described herein in further detail. The terms "chair," "sofa" and "motorized chair" are used interchangeably herein and are defined to include all types of furniture that have user-supporting elements defining surfaces that articulate using motor power. In one example, the motorized furniture could be a motorized bed, such as the beds often used in hospitals. Preferably, the motorized chair of the present invention is upholstered for a pleasing aesthetic appearance.

The control switch 15 is supported by the track 16 and slides freely along the length of the track, which preferably extends generally parallel to the adjacent one of the armrests 13. The track includes an elongated wall structure 30 having a flange 31 at its peripheral, upper edge that provides a finished look that blends with the upholstered surface when the track is installed, as shown in FIGS. 2 and 3. The walls of the wall structure 30 are spaced apart a sufficient distance to contain the control switch 15 therebetween, but still allow the control switch to slide freely. The end portions of the wall structure 30 limit the sliding travel of the control switch 15. Preferably, the wall structure defines a plurality of attachment holes 33 that can be used to fix the track 16 to the frame of the sofa 11. The track 16 also includes a floor 32 attached to the bottom of the wall structure 30, as shown in FIG. 5A in connection with another embodiment of the invention. The floor 32 of the track defines an elongated slot 34 and the outer surface of the track floor includes a spaced pair of TEFLON bearing surfaces 35, as shown in FIG. 6.

The track 16 also includes an elongated, sliding member 40 that includes an elongate base portion 44, a raised center portion 41 and a pair of wing elements 45. The sliding member 40 is fixed to the control switch 15 and slides along the slot 34 defined by the floor 32 of the track 16. The base portion 44 has a long, rectangular shape. The raised center portion 41 also has a long, rectangular shape. The raised center portion is centered on the base portion 44, has the same length as the base portion, and about half of the width of the base portion. A pair of switch attachment holes 42 and a wiring aperture 43 are defined by the raised center portion 41. The wiring aperture 43 is centered on the raised center portion 41 and the switch attachment holes 42 are spaced across the wiring aperture, along the length of the raised center portion. The wing elements 45 are a pair of rectangular tabs that are spaced across, and extend from, the elongate sides of the base portion 44. A pair of bearing ridges 46 are formed on the outward, free edges of the wing elements 45.

As shown in FIGS. 1 and 5A, the sliding member 40 is aligned with the slot 34 defined by the floor 32. The top surface of the base portion 44 is adjacent to the underside of the floor and the raised center portion 41 extends through the slot 34. The bearing ridges 46 of the wing elements 45 contact the TEFLON bearing surfaces 35 along the edges of the outer surface of the floor 32. The bearing ridges 46 and the TEFLON bearing surfaces 35 provide a smooth sliding action and lateral stability for the sliding member 40. The sliding member 40 is held in the slot 34 by its attachment to the control switch 25. The control switch 15 includes a toggle 50 supported and housed within a rectangular base 51. The underside of the rectangular base is positioned flush against the inside surface of the floor 32. The control switch is fixed to the sliding member 40 via fasteners inserted through the switch attachment holes 42 and into the base 51 of the control switch 15. Such attachment couples the movement of the sliding member 40 and the control switch 15. The wiring of the control switch extends through the wiring aperture 43, allowing the wiring to slide with the toggle 50 and base 51, and is operably connected to a motor 61 of the motorized reclining chair 11, as shown in FIG. 7.

The controller assembly 10 preferably further includes a pressure switch assembly 55, as shown in FIG. 7, that disconnects the control switch 15 from the motor 61 when the user is not seated on the seat cushion 20 of the sofa 11. The pressure switch assembly 55 includes a pair of pressure switch strips 56 that are positioned along, and supported by, a corresponding pair of the stretcher springs 25, as shown in FIG. 8. Preferably the pressure switch strips extend along the stretcher springs to within approximately 4.75 inches of the backrest 12 so as to be under the center of gravity of the seated person. The length and positioning of the strips 56 allows the pressure switch assembly 55 to sense the presence of the user seated in a variety of positions on the seat cushion 20. The strips 56 are each positioned along a respective one of the springs 25 to provide a hard surface on which to deflect the components of the strip. The pressure switch assembly 55 also includes a pair of electrical leads 62 that connect the strips 56 to a power source, the control switch 15 and the motor 61.

As shown in FIGS. 9 and 10, each strip includes a pair of metal contact strips 57 spaced apart by a pair of spacers 58 positioned between the metal contact strips. Each of the pressure switch strips 56 also includes a hook and loop (VELCRO) strip 59 and a contact wire 60. The contact wire is positioned under the pair of metal contact strips 57 and on top of the supporting one of the springs 25. The contact wire 60 acts as a pressure point that allows the metal contact strips 57 to be easily compressed together under loading to complete the circuit and allow control of the motor 61 using the control switch 15, as shown in FIG. 3. The loop or pile strip 59 is positioned under the supporting one of the springs 25 and, in the interstices of the spring defined by its sinusoidal shape, converges into contact with the underside of the bottom one of the metal contact strips 57. The bottom one of the metal contact strips has a pile or loop structure that attaches to the adjacent loop or pile strip 59. In this manner, the positioning of each of the pressure switch strips 56 is maintained during loading of the sofa chair 11 and movement of the seat cushion 20. Other devices could be used to hold the contact strips on the spring, such as a length of adhesive tape, or other two-component releasable fastening systems such as the hook and loop system described above.

It should be noted that other types of pressure switch are usable with the present invention, including pressure sensors mounted under the subframe 23 or other load bearing elements of the sofa chair 11. In addition, the track 16 could be located in other positions on the chair, such as on top of the armrest, and still allow the control switch 15 to move with the hand of the user through various positions obtainable by different types of motorized chair. It is also possible to vary the configuration of the control switch 15, such as with a pair of buttons in lieu of the toggle, and still be within the scope of the present invention.

The configuration (length, width, etc.) of the track 16 can be varied to account for such factors as different aesthetic appearances, switch types, ranges of chair motion, and reach of the user. For instance, two other embodiments of the control switch 15 and track 16 are shown in FIGS. 5A and 5B. In FIG. 5A, the base 51 of the control switch is tall enough that the toggle 50 is nearly flush with the top of the track 16 so as to be more easily reached by the user. FIG. 5B shows an internal sliding member 140. The internal sliding member is held between the inside surface of the floor 32 and a retainer 141. The internal sliding member advantageously can reduce the risk of the sliding member becoming snagged on interior parts of the sofa chair 11.

During operation of the controller assembly 10, the user sits in the reclining sofa 11 while it is in the upright position and the toggle switch is positioned near the front of the chair, as shown in FIG. 2. As the user's weight is placed on the seat cushion 20, pressure is applied by the cushion onto the pressure switch assembly 55 resting on top of the springs 25. Pressure on one, or both, of the pressure switch strips 56 forces the metal contact strips 57 closed and completes the circuit between the control switch 15 and the motor 61.

Once the circuit to the control switch 15 is closed, the user can depress the toggle 50 which starts the motor 61 and extends the linkage 21. As the linkage extends, it swings the footrest 14 attached thereto, up and out. Simultaneously, the backrest 12 reclines into the reclined position, as shown in FIG. 3. As the chair 11 moves into the reclining position, the user's hand remains on the control switch 15 and drags the control switch backwards, along the track 16. Advantageously, the movement of the control switch 15 coincides with the movement of the user's back and arm into the reclining position, maintaining the control switch within reach. To reassume the upright position, the user reverses the toggle 50 and slides the control switch 15 forward along the track while the footrest 14 is retracted and the backrest is moved to the upright position.

The present invention has several advantages. The pressure switch strips 56 are normally open, blocking inadvertent motion of the motorized chair 11 when a user is not seated in the chair. In addition, positioning two of the pressure switch strips on spaced apart stretcher springs 25 allows the strips to detect the user in a variety of seated positions. Such sensitivity is further augmented by the length of the pressure switch strips 56 extending substantially along the length of the springs 25. The use of a contact wire 60 between the contact strips 57 and the wire of the stretcher springs increases the sensitivity of the assembly to the weight of the user and allows the use of seat cushions 20 between the user and the contact strips.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A motorized chair having user-supporting elements that are movable relative to each other and are controllable by a user resting on the chair, said chair comprising:

a frame supporting at least two user-supporting elements that are movable relative to each other for positioning the user across a range of motion, one of said user-supporting elements including a plurality of springs extending in a front-to-back direction for flexibly supporting the user;

a motor connected to said frame and to the at least two user-supporting elements for moving the at least two user-supporting elements;

a position controller for controlling the motor; and at least one pressure switch strip positioned along one of the springs of the one of said user-supporting elements and extending in the front-to-back direction, said at least one pressure switch strip configured to disable the position controller when no user is on the one of said user-supporting elements, and to enable the position controller in response to the user resting on the one of said user-supporting elements so as to allow the user to activate the motor to control movement of the at least two user-supporting elements.

2. A motorized chair of claim 1, wherein the springs are stretcher springs.

3. A motorized chair of claim 2, wherein the one of said user-supporting elements further includes a pair of spaced supports supporting ends of each of the stretcher springs.

4. A motorized chair of claim 3, wherein the springs are spaced from each other along the supports.

5. A motorized chair of claim 4, further comprising a second pressure switch strip positioned along a second one of the stretcher springs.

6. A motorized chair of claim 5, wherein the pressure switch strips are positioned between the user and the stretcher springs.

7. A motorized chair of claim 1, wherein the pressure switch strip is positioned between the user and the one of the springs.

8. A motorized chair of claim 7, further comprising a cushion disposed over the at least one pressure switch strip and the one of the springs.

9. A motorized chair of claim 8, wherein the at least one pressure switch strip includes a resiliently deformable first contact strip separated by spacers from a second contact strip, and a contact wire disposed between the one of the springs and the contact strips.

10. A motorized chair having user-supporting elements that are movable relative to each other and are controllable by a user resting on the chair, said chair comprising:

a frame supporting at least two user-supporting elements that are movable relative to each other for positioning the user across a range of motion, one of said user-supporting elements including a plurality of stretcher springs for flexibly supporting the user and a pair of spaced supports supporting ends of each of the stretcher springs wherein the springs are spaced from each other along the supports;

a motor connected to said frame and to the at least two user-supporting elements for moving the at least two user-supporting elements;

a position controller for controlling the motor; and at least two pressure switch strips positioned on respective ones of the springs of the one of said user-supporting elements, said at least two pressure switch strips being positioned between the user and the stretcher springs and configured to disable the position controller when no user is on the one of said user-supporting elements, and to enable the position controller in response to the user resting on the one of said user-supporting elements so as to allow the user to activate the motor to control movement of the at least two user-supporting elements;

wherein the pressure switch strips each include a pair of contact strips separated by spacers and a contact wire disposed between the stretcher springs and the contact strips.

11. A motorized chair of claim 10, further comprising a cushion disposed over the pressure switch strips and the stretcher springs.

12. A pressure switch strip assembly for use with a motorized chair having user-supporting elements that support a user resting thereon and are movable relative to each other by a motor connected by a circuit to a controller and wherein one of the user-supporting elements includes a pair of spaced supports supporting ends of a plurality of stretcher springs extending therebetween, said assembly comprising:

a pair of elongate contact strips separated by spacers, the contact strips being configured to extend over one side of one of the stretcher springs and further configured for connection to the circuit between the motor and the controller; and an elongate contact wire configured to extend between the one of the stretcher springs and the contact strips so that the user resting on the motorized chair causes at least one of the contact strips adjacent the contact wire to deform about the contact wire such that the contact strips make electrical contact with each other and close the circuit allowing the user to control the motor with the controller and move the user-supporting elements.

13. A pressure switch strip assembly of claim 12, further comprising a connection strip configured to extend along another side of the one of the stretcher springs and intermittently adhere to the contact strips in interstices between wires of the one of the stretcher springs so as to hold the contact strips on the one of the stretcher springs.

14. A pressure switch strip assembly of claim 13, wherein the connection strip is a two-component releasable fastening system having one component attached to the contact strips on one side of the one of the stretcher springs and the other component positioned along another side of the one of the stretcher springs.

15. A pressure switch strip assembly of claim 14, wherein the two-component system is a hook and loop system.

16. A pressure switch strip assembly of claim 12, wherein a length of the elongate contact strips is sufficient to extend along the one of the stretcher springs until under a center of gravity of the user.

17. A pressure switch strip assembly of claim 12, wherein the length of the elongate contact strips extends to within 4.75 inches of a backrest supporting element of the motorized chair.

18. A method of controlling operability of a motorized chair having user-supporting elements that are movable relative to each other and are controllable by a user resting on the chair, said method comprising:

detecting the user resting on the chair using a pressure switch strip positioned in a front-to-back direction along a spring of one of the user-supporting elements wherein the spring also extends in the front-to-back direction;

closing a circuit between the motor and a controller in response to detecting the user so as to enable the controller; and moving the user-supporting elements in response to manipulation of the controller by the user.

19. A method of claim 18, further comprising detecting the user's absence from the chair using the pressure switch strip and disabling the controller so as to prohibit inadvertent movement of the user-supporting elements.

20. A method of claim 18, wherein detecting the user includes detecting the user through a cushion positioned over the user-supporting element.

21. A method of claim 18, wherein detecting the user includes detecting the user in several positions on the one of the user-supporting elements using the pressure switch strip positioned on a first spring and a second pressure switch strip positioned on a second spring spaced from the first spring.

22. A motorized furniture piece having user-supporting elements that are movable relative to each other and are controllable by a user resting on the furniture piece, said furniture piece comprising:

a frame supporting at least two user-supporting elements that are movable relative to each other for positioning the user across a range of motion, one of said user-supporting elements including a plurality of springs extending in a front to back direction for flexibly supporting the user;

a motor connected to said frame and to the user-supporting elements for moving the user-supporting elements;

a position controller for controlling the motor; and at least one pressure switch strip positioned along one of the springs of the one of the user-supporting elements and extending in the front-to-back direction, said pressure switch strip configured to disable the position controller when no user is on the one of the user-supporting elements, and to enable the position controller in response to the user resting on the one of the user-supporting elements so as to allow the user to activate the motor to control movement of the user-supporting elements.

* * * * *